US008800636B2

(12) United States Patent
Mæland et al.

(10) Patent No.: US 8,800,636 B2
(45) Date of Patent: Aug. 12, 2014

(54) EQUIPMENT FOR THE REMOVAL OF BILLETS AFTER CASTING

(75) Inventors: Geir Mæland, Ranheim (NO); Rune Fjærvik, Surnadal (NO)

(73) Assignee: Norsk Hydro ASA, Oslo (NO)

( * ) Notice: Subject to any disclaimer, the term of this patent is extended or adjusted under 35 U.S.C. 154(b) by 263 days.

(21) Appl. No.: 13/255,703

(22) PCT Filed: Mar. 29, 2010

(86) PCT No.: PCT/NO2010/000116
§ 371 (c)(1),
(2), (4) Date: Nov. 16, 2011

(87) PCT Pub. No.: WO2010/114384
PCT Pub. Date: Oct. 7, 2010

(65) Prior Publication Data

US 2012/0048499 A1 Mar. 1, 2012

(30) Foreign Application Priority Data

Mar. 31, 2009 (NO) ..... 20091340

(51) Int. Cl.
*B22D 45/00* (2006.01)

(52) U.S. Cl.
USPC ..... 164/269; 164/412

(58) Field of Classification Search
USPC ..... 164/269, 412; 266/287
See application file for complete search history.

(56) References Cited

U.S. PATENT DOCUMENTS 2,696,646 A * 12/1954 Loewenstein ..... 164/484

FOREIGN PATENT DOCUMENTS

| | | |
|---|---|---|
| DE | 9204231 | 6/1992 |
| GB | 2242148 | 9/1991 |
| JP | 7-206376 | 8/1995 |
| JP | 7-277670 | 10/1995 |
| WO | 2009/054826 | 4/2009 |

OTHER PUBLICATIONS

International Search Report issued Jun. 28, 2010 in International (PCT) Application No. PCT/NO2010/000116.

* cited by examiner

*Primary Examiner* — Kevin P Kerns
*Assistant Examiner* — Steven Ha
(74) *Attorney, Agent, or Firm* — Wenderoth, Lind & Ponack, LLP

(57) ABSTRACT

Equipment for the removal of billets (5) of aluminum after casting. The equipment lifts billets out of a casting pit (2) after the end of the casting cycle and transfers the billets to desired transport equipment (20) for transport on to a store or further treatment/processing. The equipment includes a lifting device (6) with a gripping device (21) to retain a number of billets. The lifting device is arranged so that it can move over the casting pit and lift and move the stated number of billets. A ramp (18) extends from the casting pit to transport equipment (20). The lifting device includes preferably a lifting frame that is U-shaped with legs (7, 8) that are connected to a step (11) and are arranged upright. Each leg is supported on its own wheeled chassis or wheeled bogie, while the step in the U-shaped frame connects the legs in a structure that is connected for strength.

8 Claims, 7 Drawing Sheets

EQUIPMENT FOR THE REMOVAL OF BILLETS AFTER CASTING

BACKGROUND OF THE INVENTION

1. Technical Field

The present invention concerns equipment for the removal of ingots, in particular billets, after casting, i.e. lifting the cast billets out of a casting pit after the end of the casting cycle and transferring the billet(s) to the desired transport equipment for transport on to a store or further treatment/processing.

2. Description of the Related Art

In the production of primary aluminium or remelting of aluminium, cast objects in various formats are produced, for example sheet ingots that are used when rolling aluminium into thin aluminium strips or foil and billets that are used when extruding aluminium into extended aluminium sections with different cross-sections and designs.

Both sheet ingots and billets are produced by semi-continuous casting equipment that comprises a large number of chills arranged in rows in a frame structure. Liquid metal is added to the chills via a metal manifold through a hot-top from above into the cavity of each chill. The metal is cooled and solidified in two stages. Stage 1 is called primary cooling, in which the initial solidification of the metal is achieved via cooling through the wall of the cavity in the chill. Stage 2 is called secondary cooling, in which water immediately below the primary cooling area is sprayed directly against the metal via a water gap or holes along the circumference of the chill. The equipment is placed over a casting pit with a depth equivalent to the casting length of the billets to be cast plus the structural height of a mobile support, a total depth of in the order of 10-11 meters. The mobile support under the chills is moved downwards as the metal solidifies in order to create extended bodies in the form of the billets specified, equivalent to the number of chills, which may have different diameters between 150 and 400, depending on the intended use of the billets.

After each casting operation, the casting equipment is lifted or removed in some other way from the opening over the casting pit so that the cast billets are exposed and can be removed from the casting pit. This removal is currently performed using a travelling crane with a spreader that is provided with a number of rings, each of which is connected to the spreader with a wire. Each of the rings is threaded manually down onto the end of a billet and, by lifting the spreader and thus pulling on each wire, each ring is pulled obliquely so that, by squeezing, it retains the billet onto which it is threaded and can lift the billet. In each lifting operation, a row of billets is normally lifted right out of the pit at once and then laid horizontally on a transport device, normally a roller conveyor, for transport to a store or further treatment/processing. The lifting operation in which the billets are lifted right out of the casting pit means that the fall height for the billets is high in the event of an accident. This, along with the fact that the billets are handled manually, entails a high risk for the operators who perform the work and a risk of serious injury to them.

The equipment for casting billets otherwise normally comprises several tens of chills and thus several tens of billets that need to be removed after each casting cycle. The removal work is therefore also time-consuming, which, in turn, reduces the total casting capacity.

SUMMARY OF THE INVENTION

The present invention describes equipment for the removal of billets after casting that does not involve manual work and has considerably reduced lifting of billets and thus considerably reduces or entirely eliminates the risk of injury to operators of the equipment. The equipment is automated and considerably more efficient and thus contributes to increased casting capacity. In addition, lifting out and removing billets with the present invention is not a bottleneck. The invention allows billets to be lifted out and the casting table to be maintained at the same time. The structural height of the equipment is also considerably lower than for existing lifting equipment, which, in turn, reduces the investment costs in new casting shops.

BRIEF DESCRIPTION OF THE DRAWINGS

The present invention will be described in the following in further detail using examples and with reference to the attached drawings, where.

DETAILED DESCRIPTION OF THE INVENTION

Figure 1:
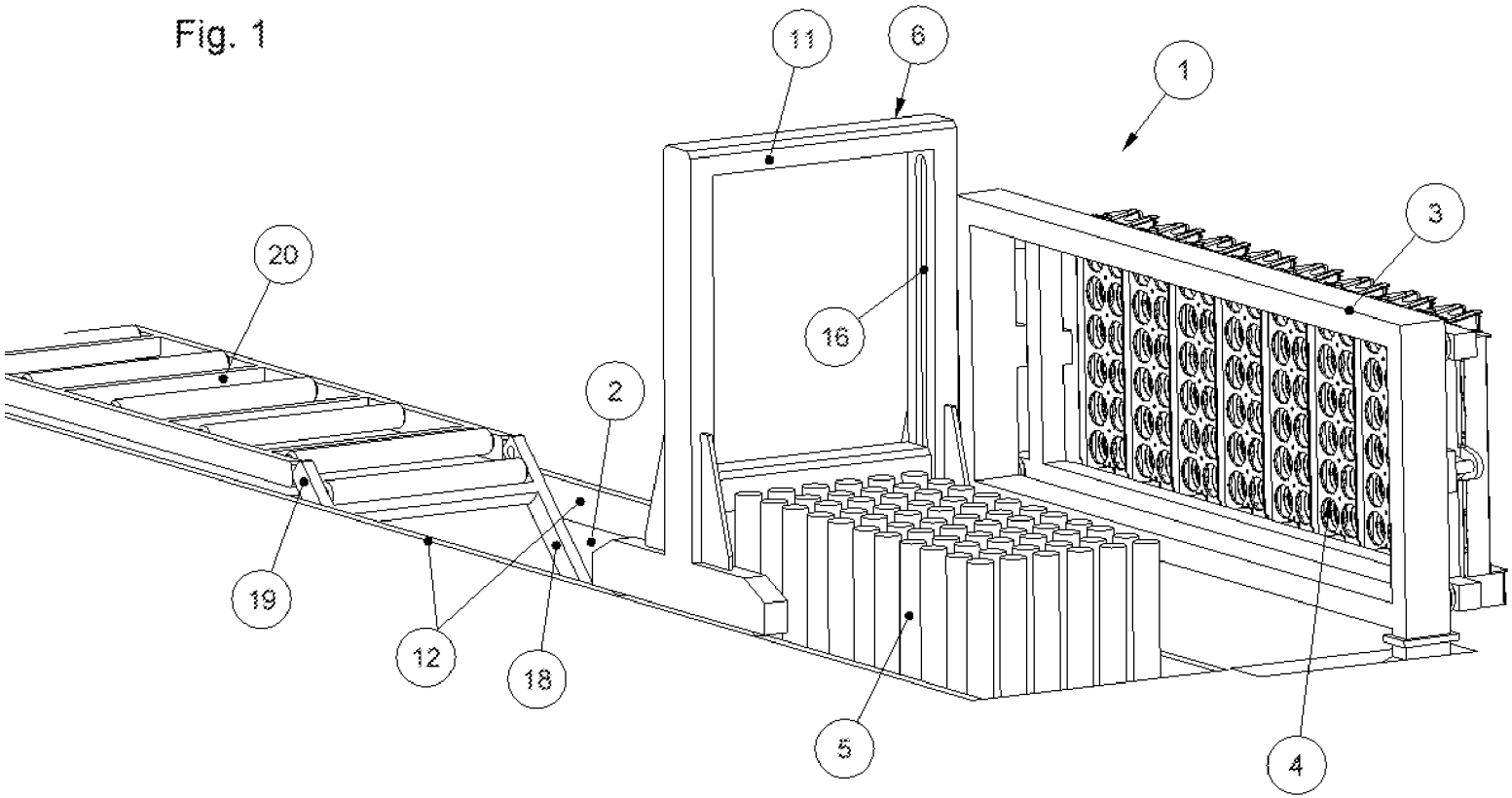
FIG. 1 shows a simple sketch of the equipment for removing billets in accordance with the invention, seen in perspective.
Figure 2:
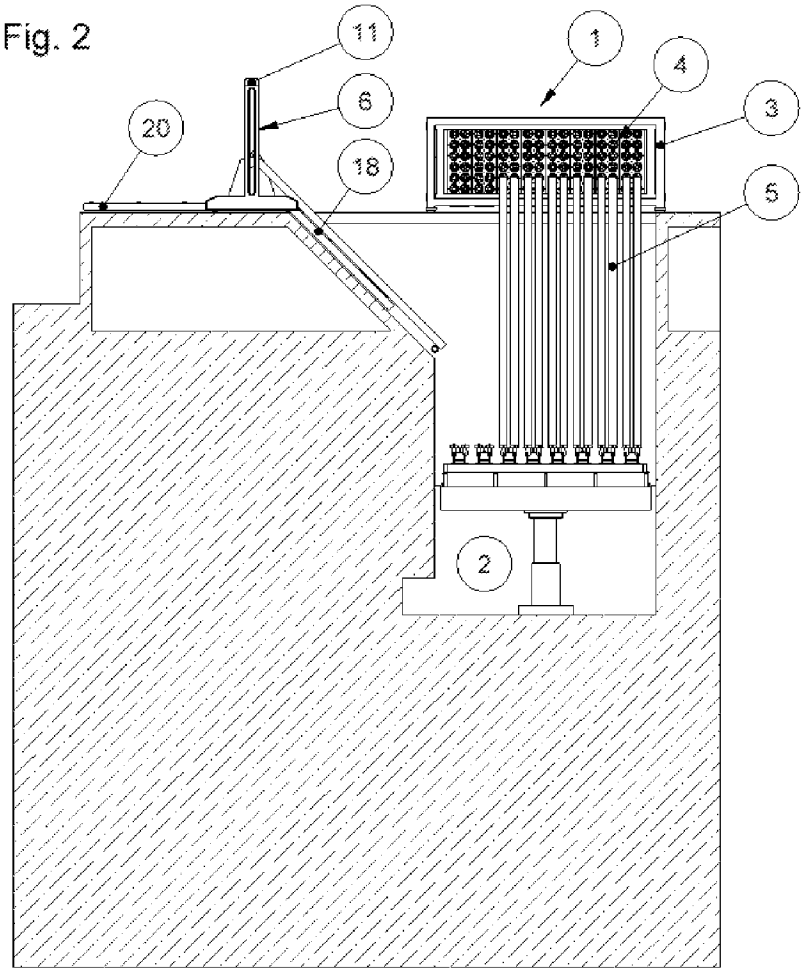
FIG. 2 shows, in slightly smaller scale, a sketch of the equipment shown in FIG. 1, but in longitudinal section.
Figure 3:
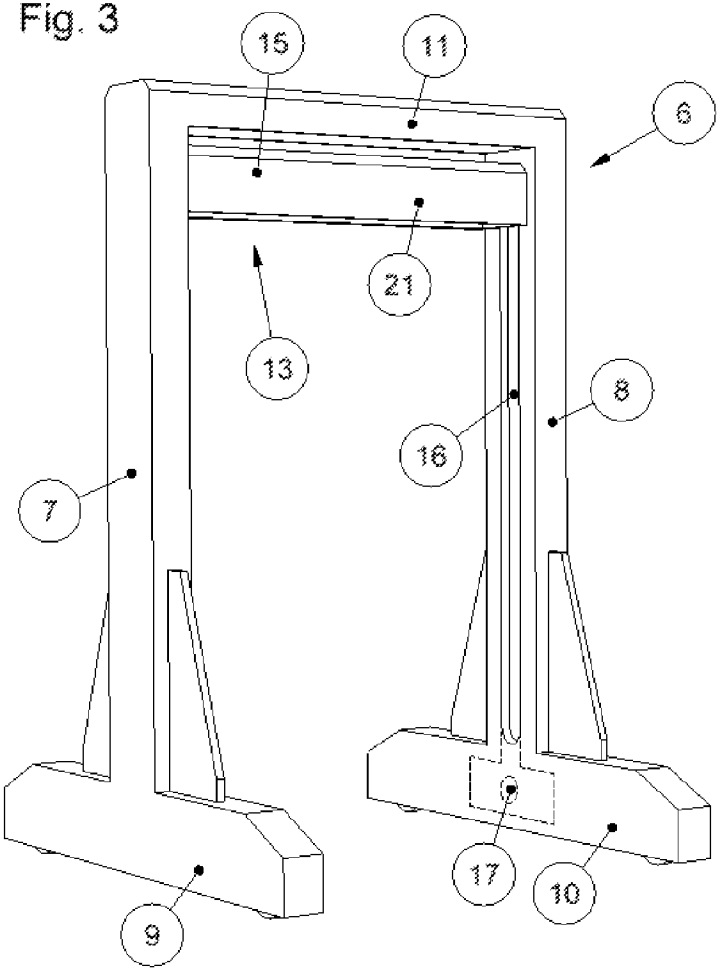
FIG. 3 shows a sketch of a U-shaped frame that is part of the equipment shown in FIGS. 1 and 2.

FIGS. 1-3 show, as stated above, equipment 1 in accordance with the invention arranged in connection with a casting pit 2 with casting equipment 3 for casting billets 5. In FIGS. 1 and 2, the casting equipment 3 is shown turned sideways up, beside the casting pit 2, around a horizontal axis and is vertically upright so that the openings for the casting chills are shown under the casting equipment as round openings 4. A number of cast billets 5 are shown sticking up from the casting pit.

The equipment 1 in accordance with the invention shown in the figures comprises a lifting device in the form of a U-shaped lifting frame 6 (see in particular FIG. 3) with legs 7, 8 that are connected to a step 11 and are arranged upright on a linear chassis such as a wheeled chassis or wheeled bogie 9, or 10, while the step 11 in the U-shaped frame 6 connects the legs 7, 8 in a structure that is connected for strength.

The frame is designed, via the wheeled bogies 9, 10, to be moved forwards and backwards along rails 12 that are arranged on each side of the casting pit 2 and extend a little past it. It is expedient for one or both of the wheeled bogies 9, 10 to be provided with a drive mechanism so that the frame is self-propelling.

Between the legs 7, 8 in the frame 1 there is a vertically mobile lifting device 13 with a gripping mechanism 21 (not shown in detail) for retaining a number of billets 5. The lifting device comprises a transverse beam 15 that is vertically mobile along a linear guide, for example in the form of vertical grooves 16 in each of the legs 7, 8, by means of a drive mechanism 17 that can expediently be based on chain operation (not shown in detail).

The gripping mechanism can be in the form of hydraulic gripping tongs or a hydraulic clamping mechanism (not shown in detail).

The equipment in accordance with the invention also comprises, in connection with the support frame 6, a rotating billet positioner, shown here inclined, in the form of a ramp 18 with a roller conveyor that is arranged between the rails 12 and along which billets that are lifted out of the casting pit are designed to be conveyed. The ramp consists expediently of a rectangular frame with transverse rollers. At the upper, rotating end 19 of the ramp 18, a second conveyor 20 is provided. The second conveyor is designed to transport the billets to a heat treatment unit or store, etc. (not shown in detail).

Figure 4:
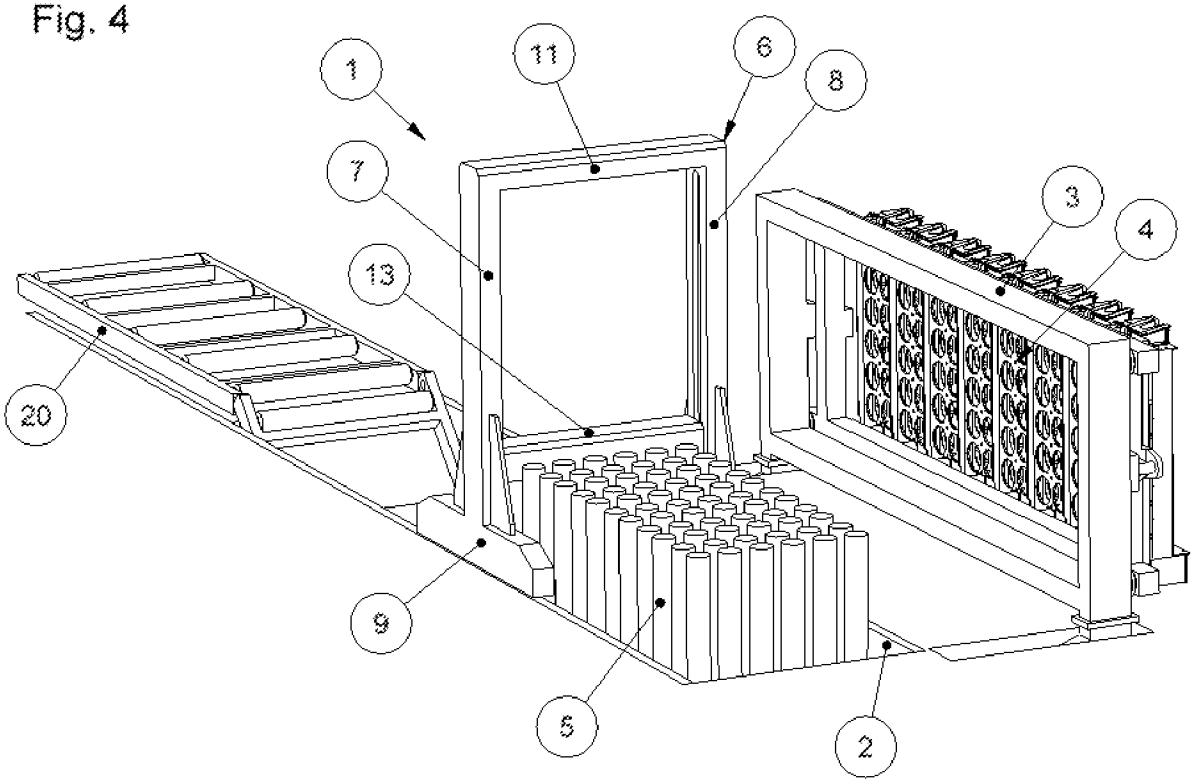
FIGS. 4-7 show a sequence of drawings of the equipment in various perspectives during an operation to remove billets after casting.

The equipment in accordance with the invention works as follows:

FIG. 4-FIG. 7 show four different sequences of the equipment 1 as it works when removing billets after a casting operation. In FIG. 4 the casting operation has just finished and the casting equipment 1 is turned upwards around a horizontal axis along the casting pit 2 to an upright position beside the casing pit with a large number of billets 5 (in this case 15 rows of 6 billets each) sticking up out of the pit. The lifting frame 6 is moved from its idle position inwards and is positioned directly over the first row of billets 5. The gripping mechanism is also lowered to and has gripped and retained the first row of billets 5. Safety barriers in connection with the casting pit (not shown in detail in the figures) are also arranged at this time in the 'safe' position so that manual maintenance of the casting equipment 1 can start at the same time. As mentioned earlier, this has not been possible with the conventional method for handling billets after casting on account of the lifting of billets over the casting pit.

Figure 5:
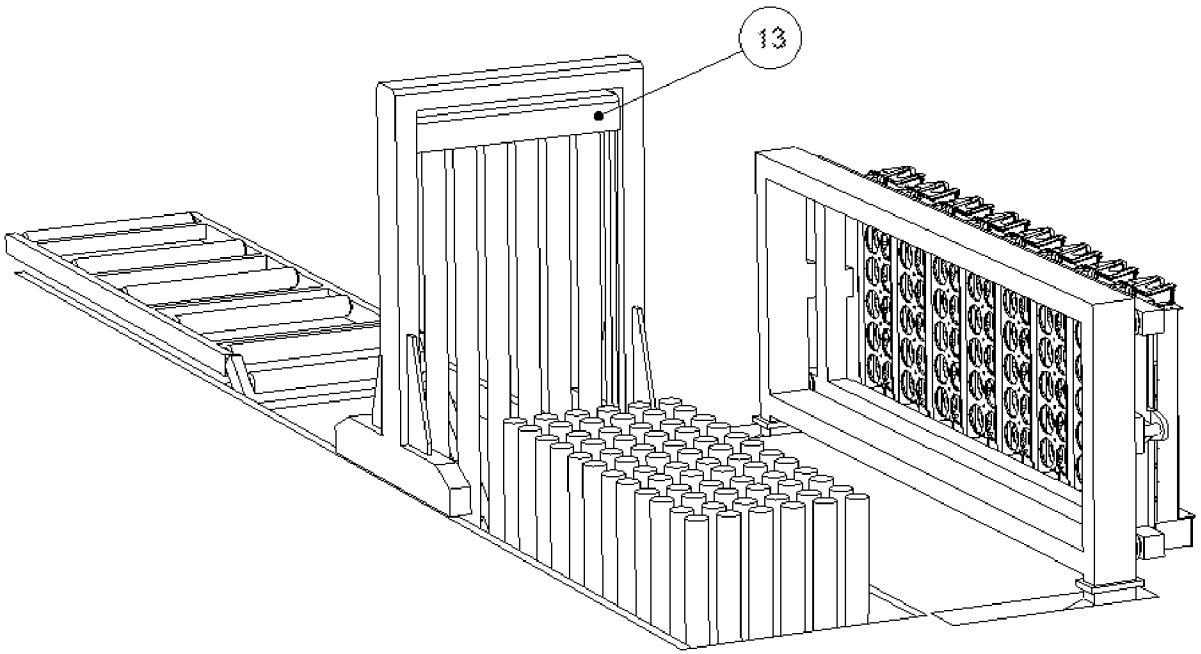

In FIG. 5 the first row of retained billets is first moved a step backwards by the lifting frame 6 to loosen the billets from the casting support. The row of billets is then lifted up and the lifting frame is in motion towards the billet positioner, i.e. the ramp 18.

Figure 6:
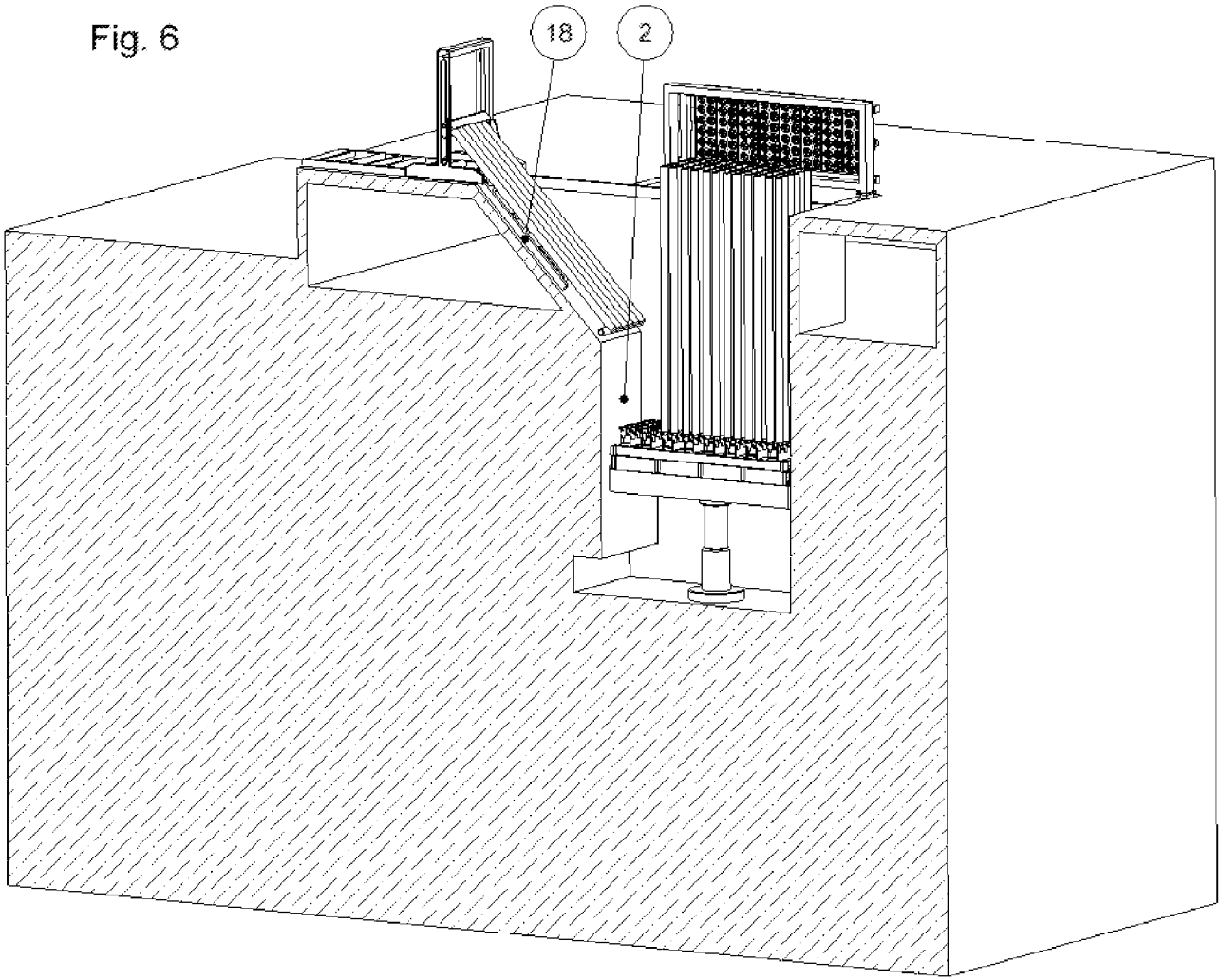
Figure 7:
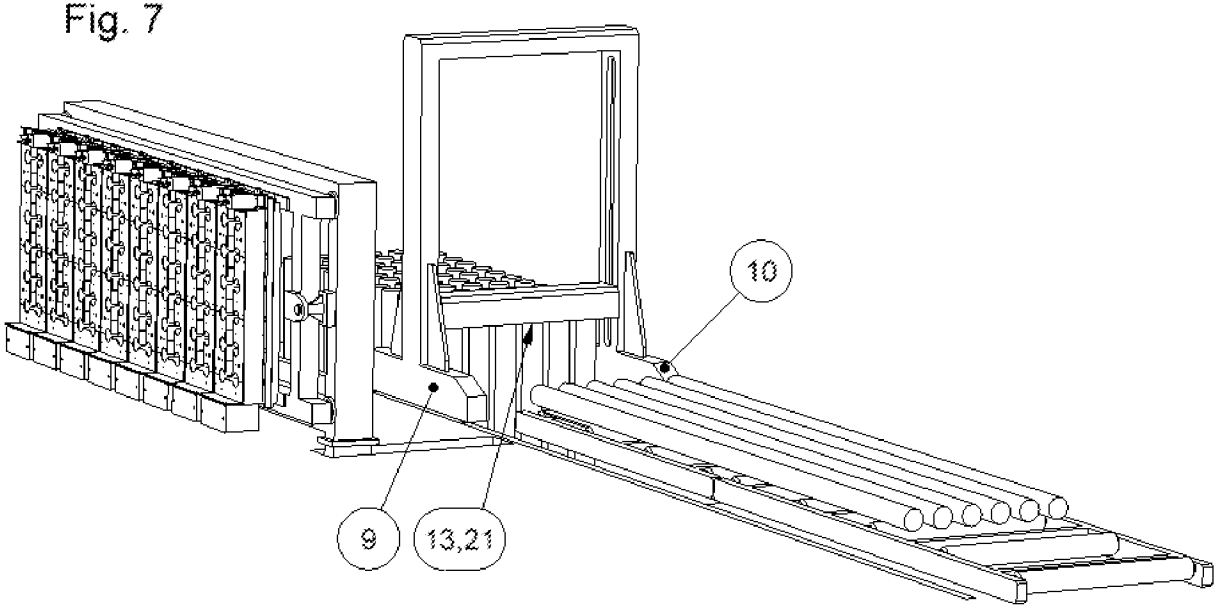

Then in FIG. 6 the lifting frame 6 is moved further along the ramp 18 so that the billets are turned around the axis of rotation of the lifting device 13 with the gripping mechanism 21 and rest at an angle of approximately 45° to the ramp 18, with the lower ends of the billets in the row of billets resting against a buffer 15. The gripping mechanism then loosens the billets and the lifting device is raised. The lifting ramp with the row of billets is then turned to a horizontal position. From here the billets are pulled further along the ramp 18 so that the billets are finally horizontal on the second roller conveyor 20 as shown in FIG. 7 and transported by it to the desired treatment location or store.

A row of billets is thus removed from the casting pit and the lifting frame can be returned and start a new sequence to remove the next row of billets as shown in FIG. 4-FIG. 7 and as described above.

It should be noted that the equipment is expediently controlled automatically by means of a PLC control unit without manual intervention. Although it is not described in detail, the equipment includes, in this connection, the necessary detectors and signalling devices to position and move the equipment that are not actually shown in detail in the figures.

It should be added that the invention, as it is defined in the claims, is not limited to the embodiment described above and shown in the figures. Therefore, the lifting device may be a device other than a U-shaped frame, for example a travelling crane. However, such a device will result in a greater structural height. The billet positioner (ramp) 18 may also be designed differently and may, instead of being a roller conveyor, consist of a belt conveyor or one or more fixed rollers towards which the billets are moved or around which the billets are turned when they are laid down.

Although, the description in the example above and shown in the figures concerns equipment linked to the casting of billets, it is important to state that the invention, as it is defined in the claims, may be used to remove all types of semi-continuously cast objects, including also all dimensions of sheet ingot.

The invention claimed is:

1. Equipment for lifting billets of aluminium out of a casting pit and transferring the billets after a casting operation, the equipment comprising:

a lifting device including a gripping device for retaining one or more of the billets, the lifting device being arranged so that it can move over a casting pit and lift and move the billets, the lifting device comprising a U-shaped lifting frame having upright legs connected to a step, each of the legs being connected at a lower end to a wheeled chassis or wheeled bogie;

transport equipment for transporting the billets to a store or further treatment or processing; and a billet positioner extending from the casting pit to the transport equipment, wherein the billet positioner comprises a ramp arranged to rotate or be inclined between the casting pit and the transport equipment, and the lifting device is arranged to move the billets into contact with the ramp which can then be rotated to permit the billets to be transported along the ramp in the direction of the transport equipment.

2. The equipment in accordance with claim 1, further comprising rails extending along opposite sides of the casting pit, wherein the wheeled chassis or wheeled bogies are supported on the rails so as to travel along each side of the casting pit.

3. The equipment in accordance with claim 1, wherein an end of the ramp is rotatably supported at an end of the transport equipment, and the end is arranged to rotate in the lifting frame.

4. The equipment in accordance with claim 1, wherein the ramp is a roller conveyor.

5. The equipment in accordance with claim 1, wherein the lifting device comprising a travelling crane.

6. The equipment in accordance with claim 1, wherein the frame is movable in a horizontal direction, and the gripping device is vertically movably supported in the U-shaped frame to permit the billets to be lifted and moved into contact with the billet positioner.

7. Equipment for lifting billets of aluminium out of a casting pit and transferring the billets to a transport device after a casting operation, the equipment comprising:

a lifting device including a gripping device for retaining one or more of the billets, the lifting device being arranged so that it can move over a casting pit and lift and move the billets, the lifting device comprising a U-shaped lifting frame having upright legs connected to a step, each of the legs being connected at a lower end to a wheeled chassis or wheeled bogie; and a billet positioner extending from the casting pit to the transport equipment, wherein the billet positioner comprises a ramp that is rotatably supported at an upper end so that the ramp can be rotated from an inclined position to a horizontal position, wherein the lifting device is arranged to lift the billets and move the billets into contact with the ramp, which can then be rotated to the horizontal position to permit the billets to be transported along the ramp in the direction of the transport equipment.

8. The equipment in accordance with claim 7, further comprising rails extending along opposite sides of the casting pit, wherein the wheeled chassis or wheeled bogies are supported on the rails so as to travel along each side of the casting pit to permit the lifting device to move over the casting pit.

* * * * *